US009647332B2

(12) United States Patent
Han et al.

(10) Patent No.: US 9,647,332 B2
(45) Date of Patent: May 9, 2017

(54) ELECTRONIC DEVICE ANTENNA WITH INTERFERENCE MITIGATION CIRCUITRY

(71) Applicant: Apple Inc., Cupertino, CA (US)

(72) Inventors: Liang Han, Sunnyvale, CA (US); Ming-Ju Tsai, Cupertino, CA (US); Matthew A. Mow, Los Altos, CA (US); Yijun Zhou, Sunnyvale, CA (US); Mattia Pascolini, San Francisco, CA (US); Salih Yarga, Sunnyvale, CA (US); Enrique Ayala Vazquez, Watsonville, CA (US); Hongfei Hu, Santa Clara, CA (US); Xu Han, San Jose, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 314 days.

(21) Appl. No.: 14/476,453

(22) Filed: Sep. 3, 2014

(65) Prior Publication Data

US 2016/0064812 A1 Mar. 3, 2016

(51) Int. Cl.

| | |
|---|---|
| ***H01Q 1/52*** | (2006.01) |
| ***H01Q 1/22*** | (2006.01) |
| ***H01Q 1/50*** | (2006.01) |
| ***H01Q 1/24*** | (2006.01) |
| ***H01Q 9/42*** | (2006.01) |
| ***H01Q 13/10*** | (2006.01) |
| ***H01Q 21/28*** | (2006.01) |

(52) U.S. Cl.

CPC ..... *H01Q 1/52* (2013.01); *H01Q 1/22* (2013.01); *H01Q 1/243* (2013.01); *H01Q 1/50* (2013.01); *H01Q 9/42* (2013.01); *H01Q 13/10* (2013.01); *H01Q 21/28* (2013.01)

(58) Field of Classification Search

CPC ..... H01Q 1/52; H01Q 1/50; H01Q 1/22
USPC ..... 343/702
See application file for complete search history.

(56) References Cited

U.S. PATENT DOCUMENTS

| | | |
|---|---|---|
| 7,896,672 B2 | 3/2011 | Felisilda De La Cruz |
| 8,682,275 B2 | 3/2014 | Kerth et al. |

(Continued)

FOREIGN PATENT DOCUMENTS

| | | |
|---|---|---|
| JP | 2012-029281 | 2/2012 |
| KR | 10-2012-0087899 | 8/2012 |
| WO | 2014105075 | 7/2014 |

*Primary Examiner* — Dameon E Levi
*Assistant Examiner* — Andrea Lindgren Baltzell
(74) *Attorney, Agent, or Firm* — Treyz Law Group, P.C.; G. Victor Treyz; Joseph F. Guihan

(57) ABSTRACT

An electronic device may be provided with an antenna. The antenna may have an antenna resonating element and an antenna ground. The antenna resonating element may be formed from peripheral conductive housing structures. An audio jack or other connector may be mounted in an opening in the peripheral conductive housing structures. The audio jack may overlap the antenna ground. Contacts in the audio jack may be coupled to an interference mitigation circuit. The interference mitigation circuit may include capacitors coupled to the ground and inductors coupled between the contacts and the capacitors. Radio-frequency signal blocking inductors may be coupled between the interference mitigation circuit and respective ports in an audio circuit.

21 Claims, 12 Drawing Sheets

(56) References Cited

U.S. PATENT DOCUMENTS

| | | | | |
|---|---|---|---|---|
| 2008/0316117 | A1* | 12/2008 | Hill | H01Q 1/243<br>343/702 |
| 2012/0020478 | A1* | 1/2012 | Wang | H04R 5/04<br>381/17 |
| 2012/0074988 | A1 | 3/2012 | Lashkari et al. | |
| 2012/0178386 | A1 | 7/2012 | Pascolini et al. | |
| 2012/0214412 | A1 | 8/2012 | Schlub et al. | |

* cited by examiner

ELECTRONIC DEVICE ANTENNA WITH INTERFERENCE MITIGATION CIRCUITRY

BACKGROUND

This relates generally to electronic devices and, more particularly, to electronic devices with antenna structures that prevent accessory interference.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures. Challenges also arise when attempting to accommodate accessories that operate in conjunction with an electronic device. Antenna performance can be adversely affected due to coupling between the antenna and an accessory plug and cable or other conductive structures in the vicinity of the device.

It would therefore be desirable to be able to provide improved wireless circuitry for electronic devices such as electronic devices that can be coupled to accessories.

SUMMARY

An electronic device may be provided with an antenna. The antenna may have an antenna resonating element and an antenna ground. The antenna resonating element may be formed from peripheral conductive housing structures. An audio jack or other connector may be mounted in an opening in the peripheral conductive housing structures. The audio jack may overlap the antenna ground.

To ensure that the antenna performs satisfactorily both when an audio plug is present in the audio jack and when the audio plug is not present, an interference mitigation circuit may be coupled to contacts in the audio jack. The interference mitigation circuit may include capacitors coupled to the ground and inductors coupled between the contacts and the capacitors. Radio-frequency signal blocking inductors may be coupled between the interference mitigation circuit and respective ports in an audio circuit.

DETAILED DESCRIPTION

Figure 1:
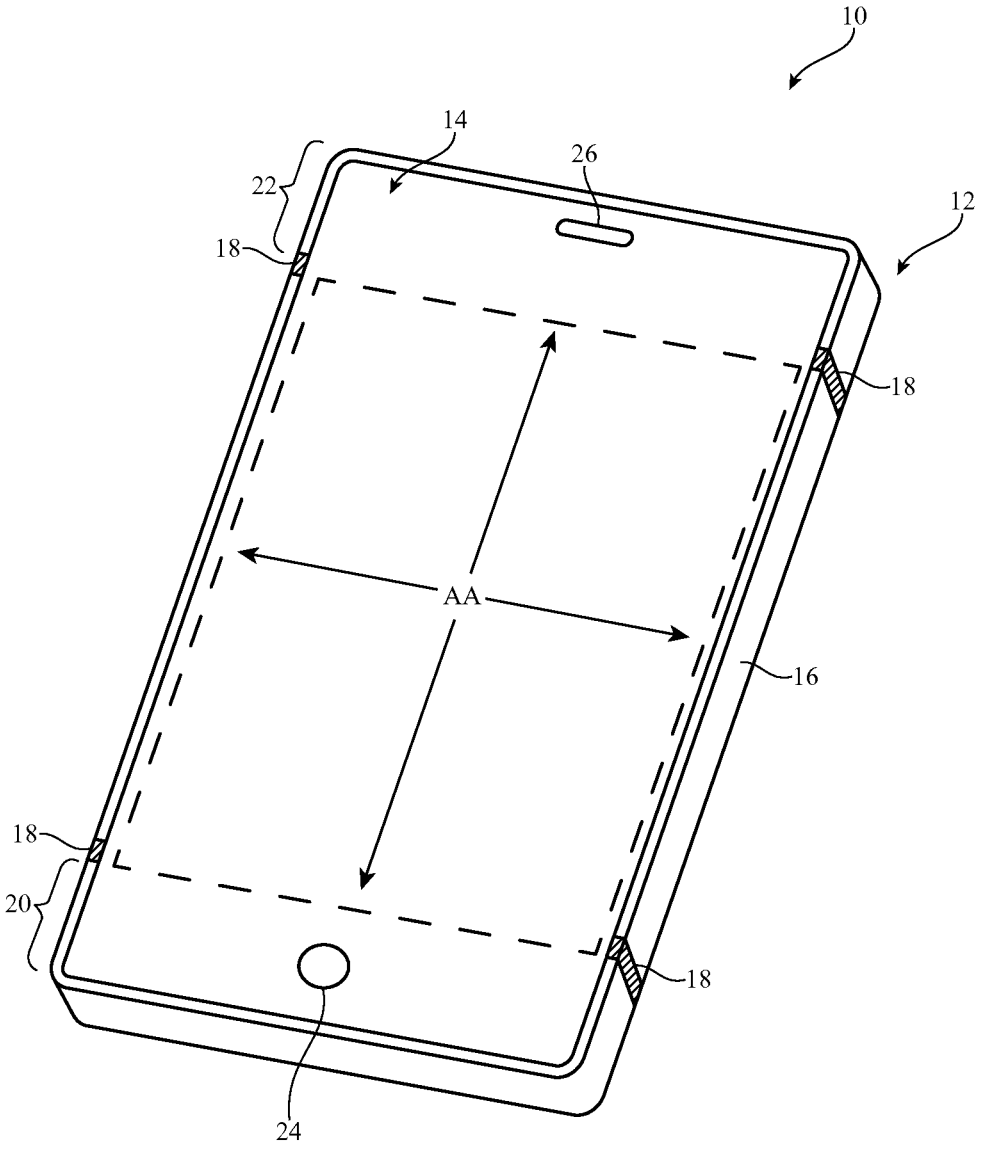
FIG. 1 is a perspective view of an illustrative electronic device with wireless circuitry in accordance with an embodiment.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps may be formed in the peripheral conductive member that divide the peripheral conductive member into segments. One or more of the segments may be used in forming one or more antennas for electronic device 10.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using a peripheral housing member have a rectangular ring shape with four corresponding edges (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures, which may be used in forming a ground plane in device 10, may be located in the center of housing 12 under active area AA of display 14 (e.g., the portion of display 14 that contains circuitry and other structures for displaying images).

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, extensions of the ground plane under active area AA of display 14 and/or other metal structures in device 10 may have portions that extend into parts of the dielectric-filled openings in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
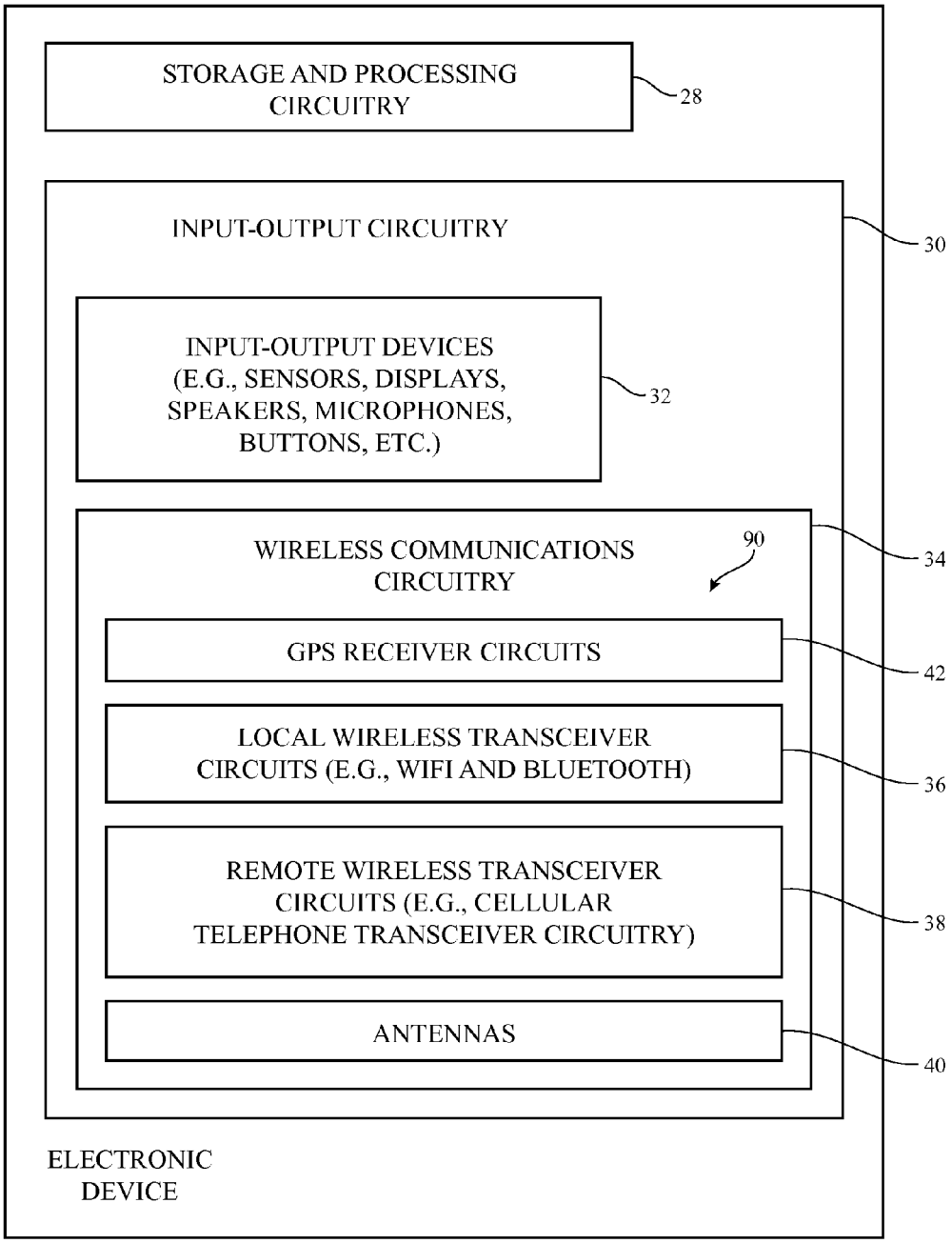
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
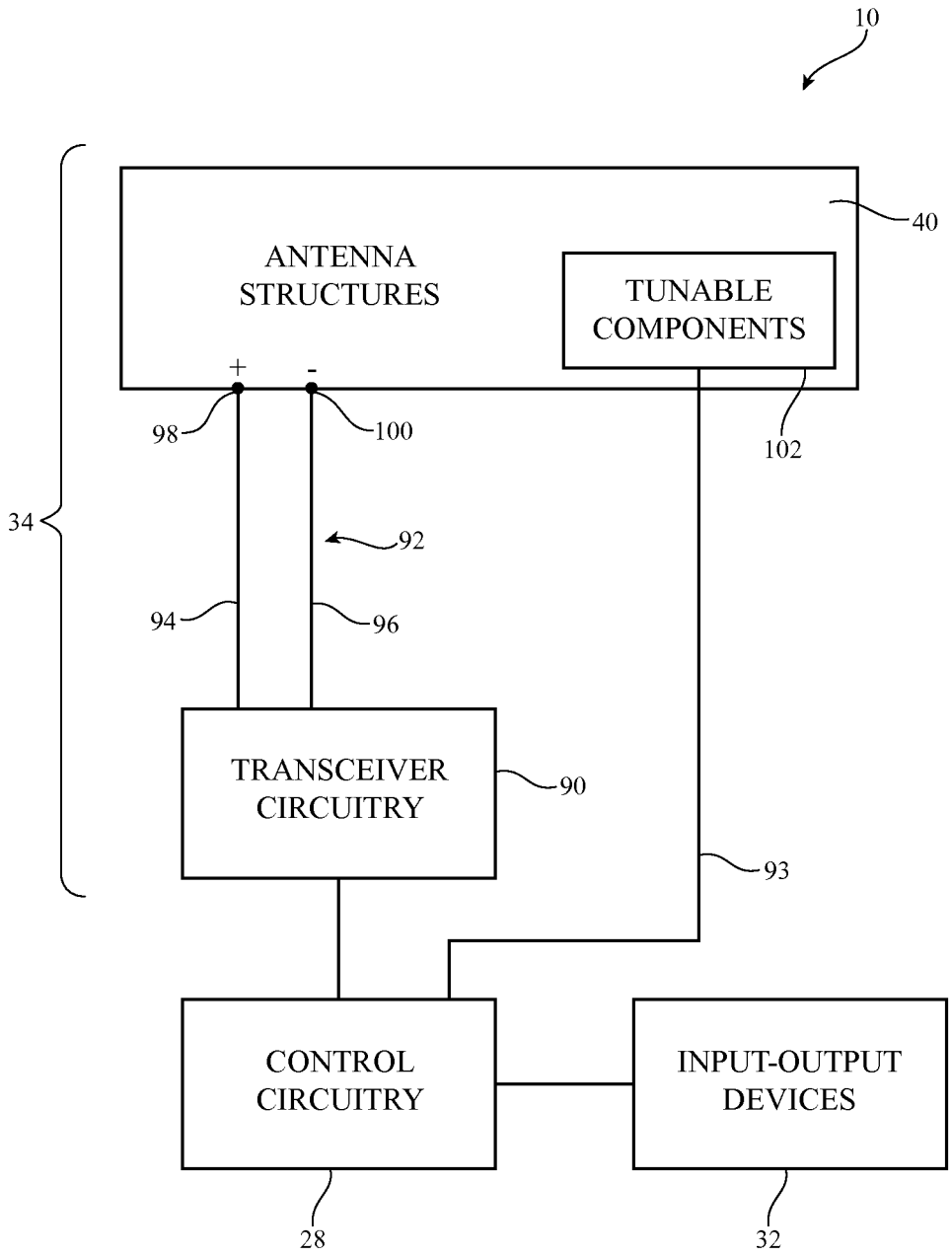
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 26 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 93 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 3 is merely illustrative.

Figure 4:
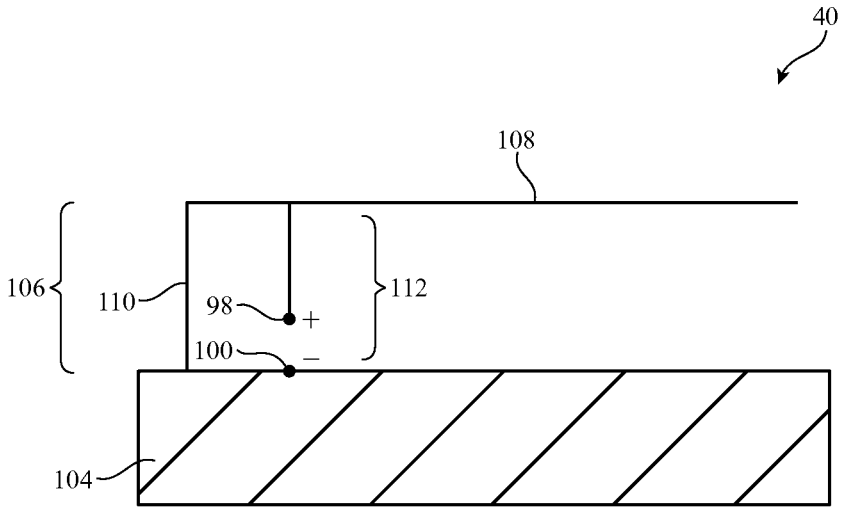
FIG. 4 is a schematic diagram of an illustrative inverted-F antenna in accordance with an embodiment.

FIG. 4 is a diagram of illustrative inverted-F antenna structures that may be used in implementing antenna 40 for device 10. Inverted-F antenna 40 of FIG. 4 has antenna resonating element 106 and antenna ground (ground plane) 104. Antenna resonating element 106 may have a main resonating element arm such as arm 108. The length of arm 108 may be selected so that antenna 40 resonates at desired operating frequencies. For example, if the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.).

Figure 5:
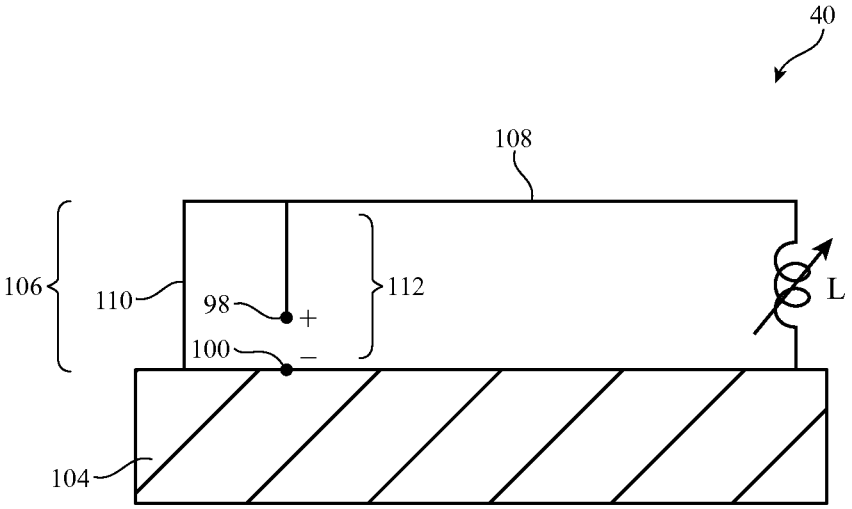
FIG. 5 is a schematic diagram of an illustrative inverted-F antenna with an inductor to tune the antenna to cover desired operating frequencies in accordance with an embodiment.

FIG. 5 is a diagram of an illustrative inverted-F antenna configuration of the type that may be used to implement a tunable antenna. As shown in FIG. 5, antenna 40 may be provided with an inductor L that couples a portion of antenna resonating element arm 108 (e.g., a tip of arm 108) in resonating element 106 to antenna ground 104. Inductor L may be a variable inductor. For example, inductor L may be an adjustable inductor that is formed from one or more transistor or other switching circuitry and a set of fixed inductors. During operation of device 10, control circuitry 28 can issue control signals that adjust the switching circuitry (e.g., that open and close transistor switches in the switching circuitry), thereby switching desired patterns of the set of fixed inductors into and out of use to adjust the inductance value of inductor L. Adjustments such as these may be made to vary the inductance of inductor L when it is desired to tune the frequency response of antenna 40 (e.g., when it is desired to tune the low band resonance of antenna 40, when it is desired to tune a mid-band resonance of antenna 40, etc.). For example, increases to the value of L may be made to increase the frequency of the communications band(s) in which antenna 40 is operating (e.g., to increase a low-band resonant frequency or a mid-band resonant frequency). One or more inductors such as inductor L may be coupled between arm 108 and ground 104 at one or more locations along the length of arm 108. The configuration of FIG. 5 is illustrative.

Figure 6:
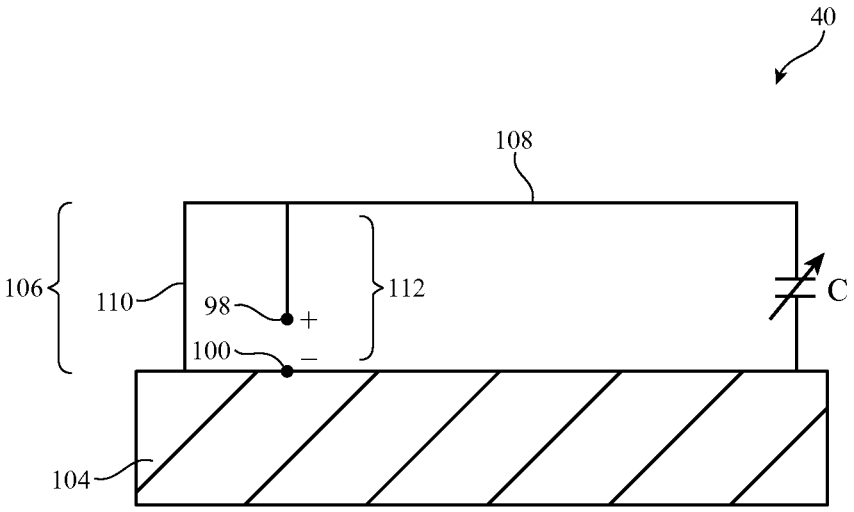
FIG. 6 is a schematic diagram of an illustrative inverted-F antenna with a capacitor to tune the antenna to cover desired operating frequencies in accordance with an embodiment.

FIG. 6 is a diagram of an illustrative inverted-F antenna structure with a capacitor that may be used to implement a tunable antenna. As shown in FIG. 6, antenna 40 may be provided with a capacitor C that couples a tip portion of antenna resonating element arm 108 in resonating element 106 to antenna ground 104. Capacitors such as capacitor C may also be coupled to arm 108 at other locations. Capacitor C may be a fixed capacitor or may be a variable capacitor. For example, capacitor C may be formed from one or more switches or other switching circuitry and a set of fixed capacitors (e.g., a programmable capacitor) or a varactor. During operation of device 10, control circuitry 28 can issue control signals that open and close switches in the switching circuitry to switch desired capacitors into and out of use or that otherwise make adjustments to capacitor C, thereby varying the capacitance value exhibited by capacitor C. Adjustments such as these may be made to vary the capacitance of capacitance C when it is desired to tune the frequency response of antenna 40 (e.g., when it is desired to tune the low band resonance of antenna 40, when it is desired to tune a mid-band resonance of antenna 40, or when it is desired to tune a high band resonance of antenna 40). For example, increases to the value of C may be made to decrease the frequency range of the communications band(s) in which antenna 40 is operating (e.g., to decrease a high-band resonant frequency). Capacitor C need not be located at the tip of arm 108. For example, the resonant frequency decrease associated with inclusion of capacitor C in antenna 40 can be enhanced by locating capacitor C closer to feed 112. If desired, antenna 40 can be implemented using a pair of fixed capacitances C (e.g., fixed capacitances associated with gaps 18 at either end of a two-branch inverted-F antenna resonating element formed from a peripheral conductive structure such as a segment of peripheral structure 16) and variable capacitors can be omitted (as an example).

In general, antenna 40 may have one or more adjustable components (adjustable inductors, adjustable capacitors, etc.). The configurations of FIGS. 5 and 6 are merely illustrative.

Figure 7:
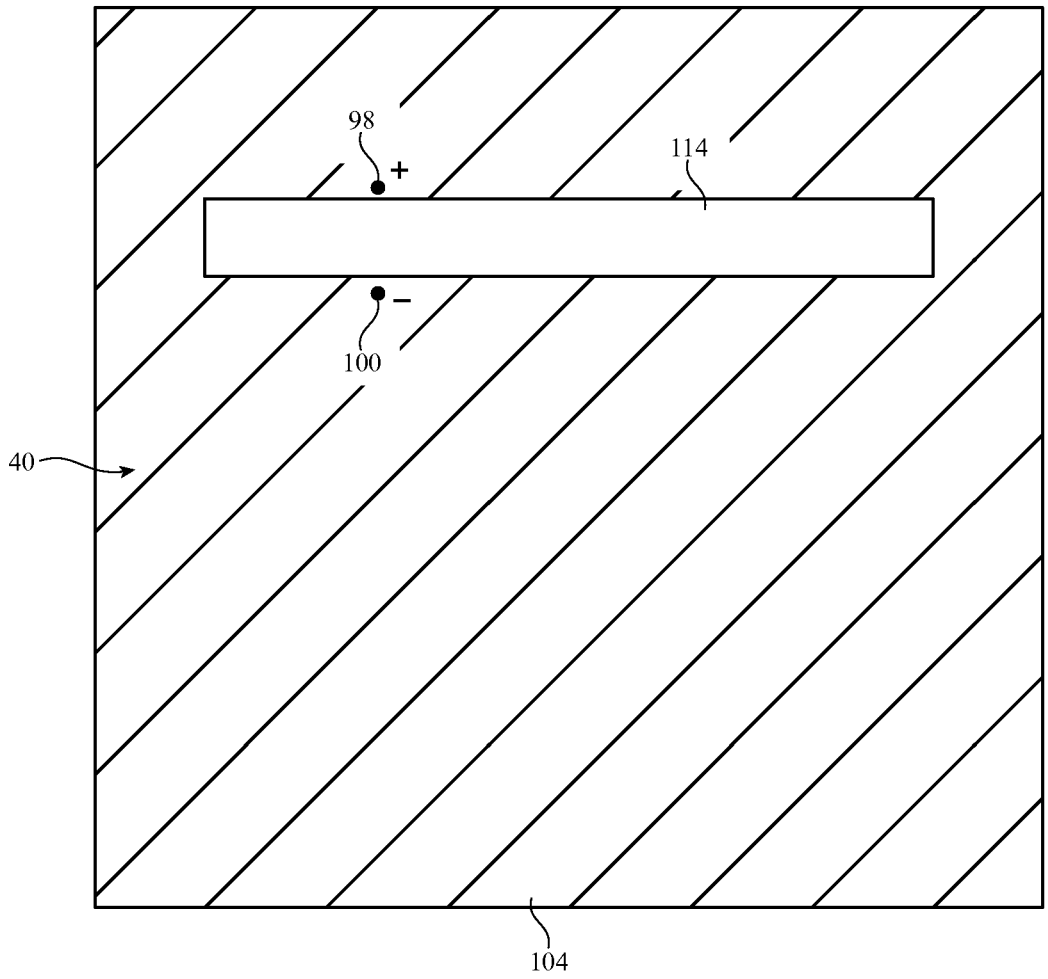
FIG. 7 is a diagram of an illustrative slot antenna in accordance with an embodiment of the present invention.

Antenna 40 may include a slot antenna resonating element. As shown in FIG. 7, for example, antenna 40 may be a slot antenna having an opening such as slot 114 that is formed within antenna ground 104. Slot 114 may be filled with air, plastic, and/or other dielectric. The shape of slot 114 may be straight or may have one or more bends (i.e., slot 114 may have an elongated shape follow a meandering path). The antenna feed for antenna 40 may include positive antenna feed terminal 98 and ground antenna feed terminal 100. Feed terminals 98 and 100 may, for example, be located on opposing sides of slot 114 (e.g., on opposing long sides). Slot-based antenna resonating elements such as slot antenna resonating element 114 of FIG. 7 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength. Slot antenna frequency response can be tuned using one or more tunable components such as tunable inductors or tunable capacitors. These components may have terminals that are coupled to opposing sides of the slot (i.e., the tunable components may bridge the slot). If desired, tunable components may have terminals that are coupled to respective locations along the length of one of the sides of slot 114. Combinations of these arrangements may also be used.

If desired, antenna 40 may incorporate conductive device structures such as portions of housing 12. As an example, peripheral conductive housing structures 16 may include multiple segments such as segments 16-1, 16-2, and 16-3 of FIG. 8 that are separated from each other by gaps 18 (e.g., spaces between the adjoining ends of the segments that are filled with plastic or other dielectric). In antenna 40 of FIG. 8, segment 16-1 may be formed from a strip of stainless steel or other metal that forms a segment of a peripheral conductive housing member (e.g., a stainless steel member or other peripheral metal housing structure) that runs around the entire periphery of device 10.

Segment 16-1 may form antenna resonating arm 108 for an inverted-F antenna. For example, segment 16-1 may form a dual-band inverted-F antenna resonating element having a longer branch that contributes an antenna response in a low frequency communications band (low band LB) and having a shorter branch that contributes an antenna response in a middle frequency communications band (middle band MB). Dual-band inverted-F antenna structures of this type may sometimes be referred to as T-shaped antennas or T-antennas. A return path conductor such as a strip of metal may be used to form return path 110 between peripheral conductive segment 16-1 (i.e., the main resonating element arm of the T-antenna resonating element) and antenna ground 104.

Antenna ground 104 may have ground structures such as a substantially rectangular antenna ground plane portion in the center of device 10 (e.g., the portion of device underlying active area AA of display 14 of FIG. 1). Antenna ground 104 may also have a portion such as ground plane extension 104E that extends outwards from the main antenna ground region in device 10. Ground plane extension 104E may protrude into an end region of device 10 such as lower end region 20. Ground plane extension 104E of antenna ground 104 may be separated from the main portion of antenna ground 104 and peripheral segment 16-1 by an opening that forms antenna slot 114. Antenna slot 114 may be fed using antenna feed 112 (i.e., using antenna feed terminals on opposing sides of slot 114 such as positive antenna feed terminal 98 and ground antenna feed terminal 100). The magnitude of the periphery of antenna slot 114 may determine the frequency at which slot 114 resonances and may therefore be used to produce a desired resonance for antenna 40 (e.g., a high band resonance HB that complements low band resonance LB and midband resonance MB associated with the T-antenna formed from segment 16-1).

When operating antenna 40 in device 10, both the T-antenna formed from segment 16-1 of peripheral conductive housing structures 16 (i.e., the inverted-F antenna) and the slot antenna formed from slot 114 may contribute to the overall response of the antenna. Because two different types of antenna contribute to the operation of antenna 40 (i.e., the inverted-F antenna portion and the slot antenna portion), antenna 40 may sometimes be referred to as a hybrid inverted-F slot antenna or hybrid antenna.

If desired, optional electrical components such as inductors and/or capacitors may be coupled to antenna 40. For example, one or more inductors such as inductors L1, L2, and L3 may bridge slot 114 or may be coupled to different locations along the periphery of slot 114 and/or one or more capacitors may bridge slot 114 or may be coupled to different locations along the periphery of slot 114. Capacitances may be formed by discrete components (capacitors) or may be produced by the metal structures of FIG. 8. For example, the metal portions of peripheral conductive structures 16 that are separated by gaps 18 from ground 104 may produce capacitances at the left and right ends of resonating element 108. Inductor L1 may bridge the left-hand gap 18 and may help compensate for the capacitance associated with the left-hand gap 18. Inductor L3 may bridge the right-hand gap 18 and may help compensate for the capacitance associated with the right-hand gap 18. Inductor L2 may be an adjustable inductor that can be adjusted by control circuitry 28 to produce various different inductance values. Adjustments to the value of inductor L2 may be used, for example, to perform low-band tuning for antenna 40.

Figure 8:
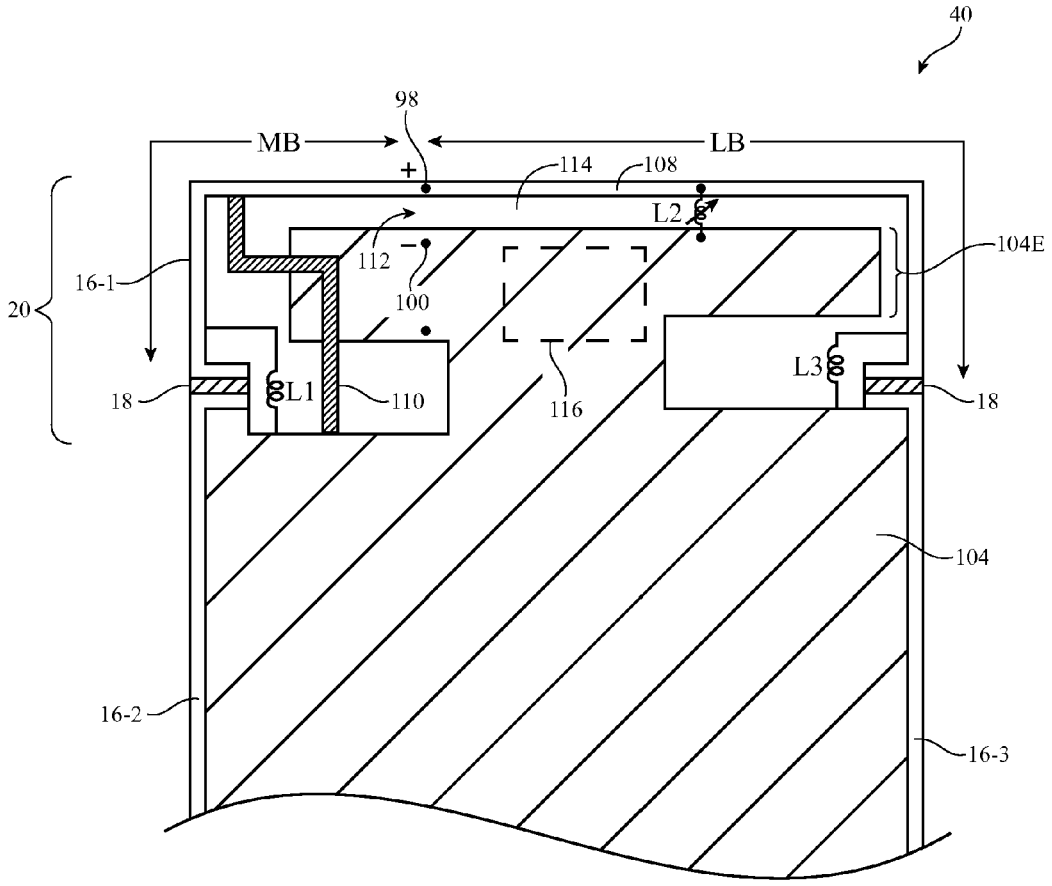
FIG. 8 is a diagram of an illustrative hybrid inverted-F slot antenna in accordance with an embodiment.

In general, device 10 may contain one or more antennas 40 and each antenna may include structures of the type shown in FIG. 8 or other suitable antenna structures (e.g., inverted-F antenna structures, slot antenna structures, hybrid antenna structures, patch antenna structures, etc.). Each antenna 40 in device 10 may include peripheral conductive housing structures such as structures 16-1 of FIG. 8 or other conductive antenna structures (e.g., metal housing structures or other structures for forming antenna resonating elements such as resonating element 108 and/or antenna ground 104). The illustrative configuration of antenna 40 that is shown in FIG. 8 is merely illustrative.

It may be desirable to use device 10 in conjunction with one more other electronic devices (sometimes referred to as external electronic devices or accessories). Additional electronic equipment that may be used with device 10 includes base stations, charging stations, headphones, earbuds, speakers, audio equipment, computers, tablet computers, portable devices such as wrist-watch and cellular telephone devices, wearable electronic equipment, and other accessories.

Accessories such as headphones (e.g., earbuds, over-the-ear headphones, etc.) may be coupled to electronic device 10 using a cable or other signal path. The cable or other signal path may be terminated with an electrical connector. The electrical connector may be a plug (e.g., a male connector such as an audio plug or data plug) or other suitable connector structure. The connector may be an audio connector, a connector that includes contacts that carry digital signals, a connector that includes contacts that carry audio signals, a connector that includes contacts that carry analog signals, and/or a connector that includes contacts that carry power signals.

The plug or other connector may be provided at the end of a cable that is pigtailed to a set of headphones or other accessory, may be part of a stand-alone cable (e.g., an extension cable or a cable that has one end that plugs into an accessory and an opposing end with a connector to be connected to device 10), or may be provided as part of an accessory (e.g., as part of a dock). Arrangements in which the external equipment that operates with device 10 is a set of headphones or other accessory having an associated cable terminated with an audio jack may sometimes be described herein as an example. This is, however, merely illustrative.

In general, device 10 may operate in cooperation with any suitable external electronic equipment having a connector.

When the audio plug or other connector associated with the accessory is plugged into device 10, antenna structures such as the antenna resonating element structures formed from peripheral conductive structures 16-1 may be electromagnetically coupled to the plug, cable, and other conductive portions of the accessory. For example, a headphone cable and audio plug may be coupled to peripheral conductive structures 16-1 through capacitive coupling. This gives rise for a potential for interference between the accessory and antenna 40, because antenna currents from peripheral conductive structures 16-1 may flow through the audio plug and other conductive accessory structures. When the accessory is not present, antenna 40 will not be disrupted by the presence of the accessory and will operate normally. When the set of headphones or other accessory is plugged into an audio jack near peripheral conductive structures 16-1 in device 10, however, there is a risk of interference with antenna 40.

To ensure that antenna 40 operates satisfactorily regardless of whether an accessory is plugged into device 10 or not, interference mitigation circuitry may be coupled to the audio jack. This circuitry forms a radio-frequency short circuit path that draws parasitic antenna current to a known ground location whenever an audio plug is inserted into the audio jack. The interference mitigation circuitry may be tuned to ensure that antenna 40 operates satisfactorily in the presence of the audio plug. When the plug is not present, the interference mitigation circuitry will not interfere with the desired operation of the antenna. The interference mitigation circuitry therefore allows antenna 40 to operate satisfactorily both in the presence of the audio plug and in the absence of the audio plug.

Figure 9:
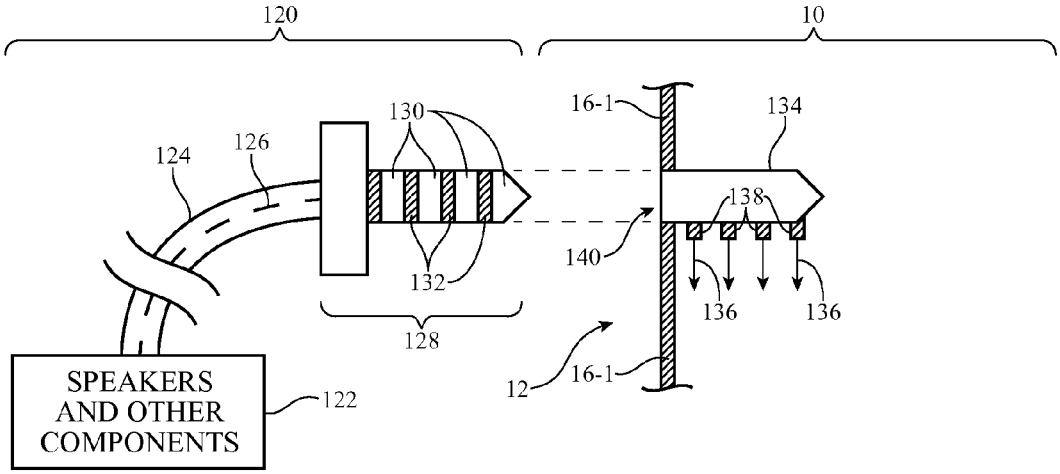
FIG. 9 is a diagram of an illustrative accessory having a cable with a plug that is being received within a mating connector in an electronic device in accordance with an embodiment.

FIG. 9 is a diagram showing an illustrative system that includes an accessory having a cable and an audio plug. The illustrative system of FIG. 9 also includes an associated audio jack in device 10 for receiving the audio plug. As shown in FIG. 9, device 10 may include a connector such as audio jack connector 134. Connector 134 may have contacts 138 that mate with corresponding contacts 130 in plug 128 of accessory 120 when plug 128 is inserted in audio jack 134. Signal lines 136 may be used to distribute signals from connectors such as audio jack 134 to circuitry in device 10 such as audio circuitry and other input-output circuitry 30. In the example of FIG. 9, audio jack 134 has four contacts (pins) 138. This is merely illustrative. Audio jack 134 may have any suitable number of contacts (e.g., one or more, two or more, three or more, four or more, five or more, six or more, ten or more, etc.). Accessory connectors such as plug 128 may likewise have any suitable number of contacts 130 (e.g., one or more, two or more, three or more, four or more, five or more, six or more, ten or more, etc.). Insulating structures 132 may separate respective contacts 130 from each other. Audio plug 128 may be a ⅛" audio plug such as a tip-ring-sleeve (TRS) connector, a tip-ring-ring-sleeve (TRRS) connector, or other suitable connector. The audio plug configuration of FIG. 9 is merely illustrative.

Accessory 120 may include a cable such as cable 124. Cable 124 may include signal paths 126 that couple contacts 130 to corresponding components 122 such as left and right speakers (e.g., earbuds, etc.), buttons (e.g., buttons in a button controller in a headset), microphones (e.g., noise-cancellation microphones and associated control circuitry), integrated circuits, and other electronic components 122 in accessory 120. Cable 124 may have a connector that plugs into a mating connector in components 122 or may be pigtailed to components 122 (as examples).

Audio jack 134 may be mounted in device 10 in a location that allows mating audio plug 128 to be inserted into audio jack 134. For example, audio jack 134 may be mounted in alignment with a housing opening such as opening 140 in peripheral conductive structures 16-1 in housing 12 (i.e., jack 134 may be mounted in an opening in structures 16-1 or other structures in housing 12). This may give rise to coupling between antenna 40 (which may have antenna currents that flow through structures 16-1) and audio plug 128 (i.e., when plug 128 is inserted within jack 134). The potential of audio plug 128 and cable 124 to carry a portion of the antenna currents associated with operation of antenna 40 gives rise to a risk that the performance of antenna 40 will be adversely affected when audio plug 128 is present in device 10.

This risk can be reduced or eliminated by incorporating interference mitigation circuitry in device 10. The interference mitigation circuitry may be implemented using circuit components such as inductors and capacitors in the vicinity of audio jack 134. In particular, the effects of interference can be mitigated using interference mitigation circuitry that is coupled to contacts 138. The interference mitigation circuitry may, for example, be interposed between contacts 138 and ground. Audio circuitry and other input-output circuitry 30 in device 10 may be coupled to the interference mitigation circuitry (e.g., to allow the audio circuitry to transmit and receive signals through contacts 138).

Figure 10:
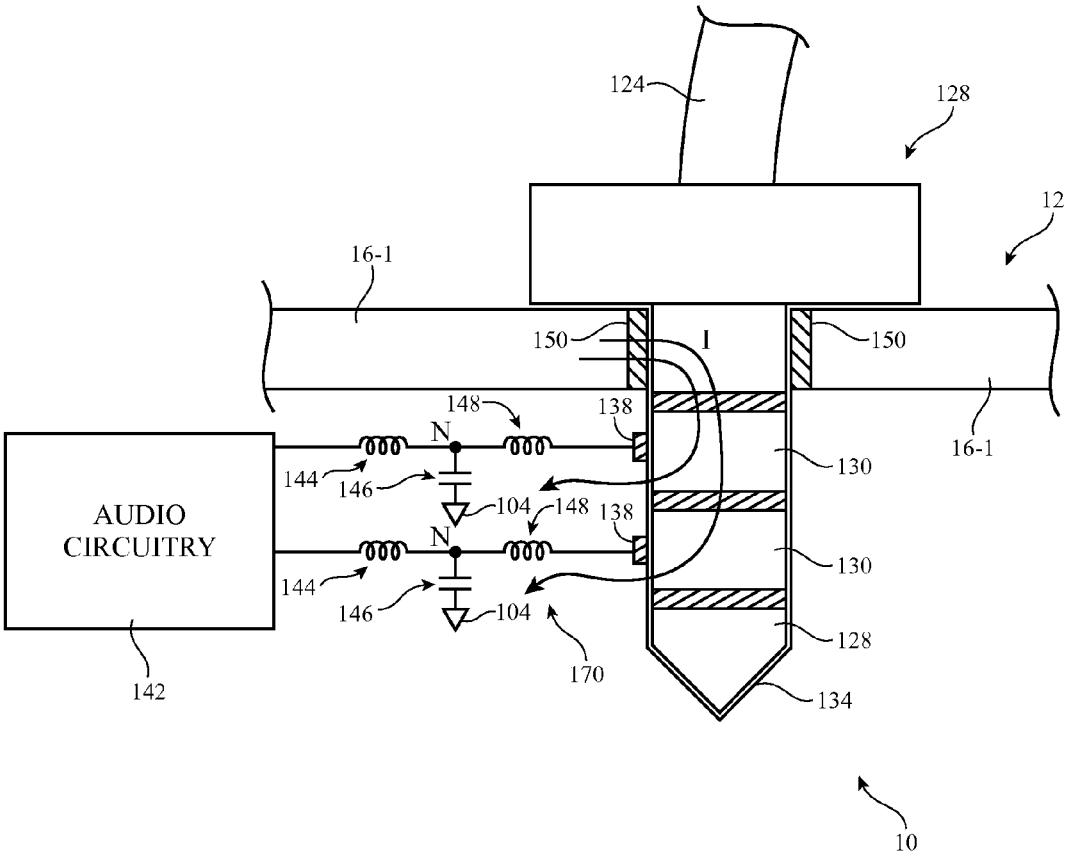
FIG. 10 is a diagram of illustrative circuitry in an electronic device that may be used to ensure that an antenna within the device performs satisfactorily in the presence of an accessory plug in accordance with an embodiment.

FIG. 10 is a diagram of a portion of device 10 in which illustrative interference mitigation circuitry 170 has been coupled to audio jack 134 to prevent the presence of audio plug 128 from disrupting operation of antenna 40. In the example of FIG. 10, interference mitigation circuitry 170 includes inductor(s) 148 and bypass capacitor(s) 146.

As shown in FIG. 10, audio jack 134 may be mounted to peripheral conductive structures 16-1 in electronic device housing 12 of device 10. Peripheral conductive structures 16-1 may form antenna resonating element 108 or other conductive antenna structures for antenna 40. When it is desired to couple accessory 120 to device 10, a user may insert audio plug 128 into audio jack 134 through an opening in peripheral conductive housing structures 16-1 (see, e.g., opening 140 of FIG. 9). Insulation 150 (e.g., plastic, glass, ceramic, or other dielectric material) may surround the opening in structures 16-1 to ensure that metal portions of audio plug 128 do not short to structures 16-1. There are four contacts 130 in plug 128 of FIG. 10, two of which are coupled to contacts 138 and interference mitigation circuitry 170. This is merely illustrative. Plug 128 may have any suitable number of contacts 130 and any suitable number of contacts 130 may be connected to respective inductors and capacitors an interference mitigation circuit.

One or more of the contacts 130 of plug 128 may be electrically connected to one or more corresponding contacts in audio jack 134 such as illustrative contacts 138. Audio circuitry 142 may be coupled to contacts 138 (and thereby contacts 130) through series-coupled inductors 144 and 148. Each inductor 144 has a terminal coupled to a respective one of inductors 148 at a respective one of nodes N. Bypass capacitors 146 are each coupled between a respective one of nodes N and ground 104. Due to the close proximity of audio jack 128 and structures 16-1, audio jack 128 (e.g., metal associated with contacts 130 and other signal paths in cable 124 and audio jack 128) is capacitively coupled to structures 16-1. As a result, antenna currents I from structures 16-1 may flow into audio plug 128 and, via contacts 138 and interference mitigation circuitry 170 to ground 104.

Audio circuitry 142 may be coupled to audio jack 134 by inductors 144 and interference mitigation circuitry 170. Inductors 144 may serve as radio-frequency signal blocking inductors (chokes) that prevent radio-frequency antenna signals associated with operation of antenna 40 from reaching audio circuitry 142. At the same time, audio signals associated with audio circuitry 142 may pass through inductors 144 (and through inductors 148). Inductors 144 (and the circuitry of inductors 148 and capacitors 146) may serve as low pass filters each of which has a cut-off frequency that is above audio signal frequencies (e.g., above 20 kHz) and below radio-frequency signal frequencies (e.g., below 700 MHz, below 1 MHz, etc.).

Inductors 144 and inductors 148 are coupled in series between the input-output ports of audio circuitry 142 and respective contacts 138 in audio jack 134. For example, in each signal path between a respective input-output port in circuitry 142 and a respective contact 138, an inductor 144 may be coupled to an inductor 148 at a node N. Each inductor 144 may have a first terminal connected to a port of audio circuitry 142 and a second terminal connected to node N. Each inductor 148 may have a first terminal connected to node N and a second terminal coupled to one of contacts 138. Bypass capacitors 146 are each coupled between a node N and ground 104. The size of capacitors 146 is preferably sufficiently large to provide a low-impedance path to ground for alternating current signals such as radio-frequency antenna currents I.

Figure 11:
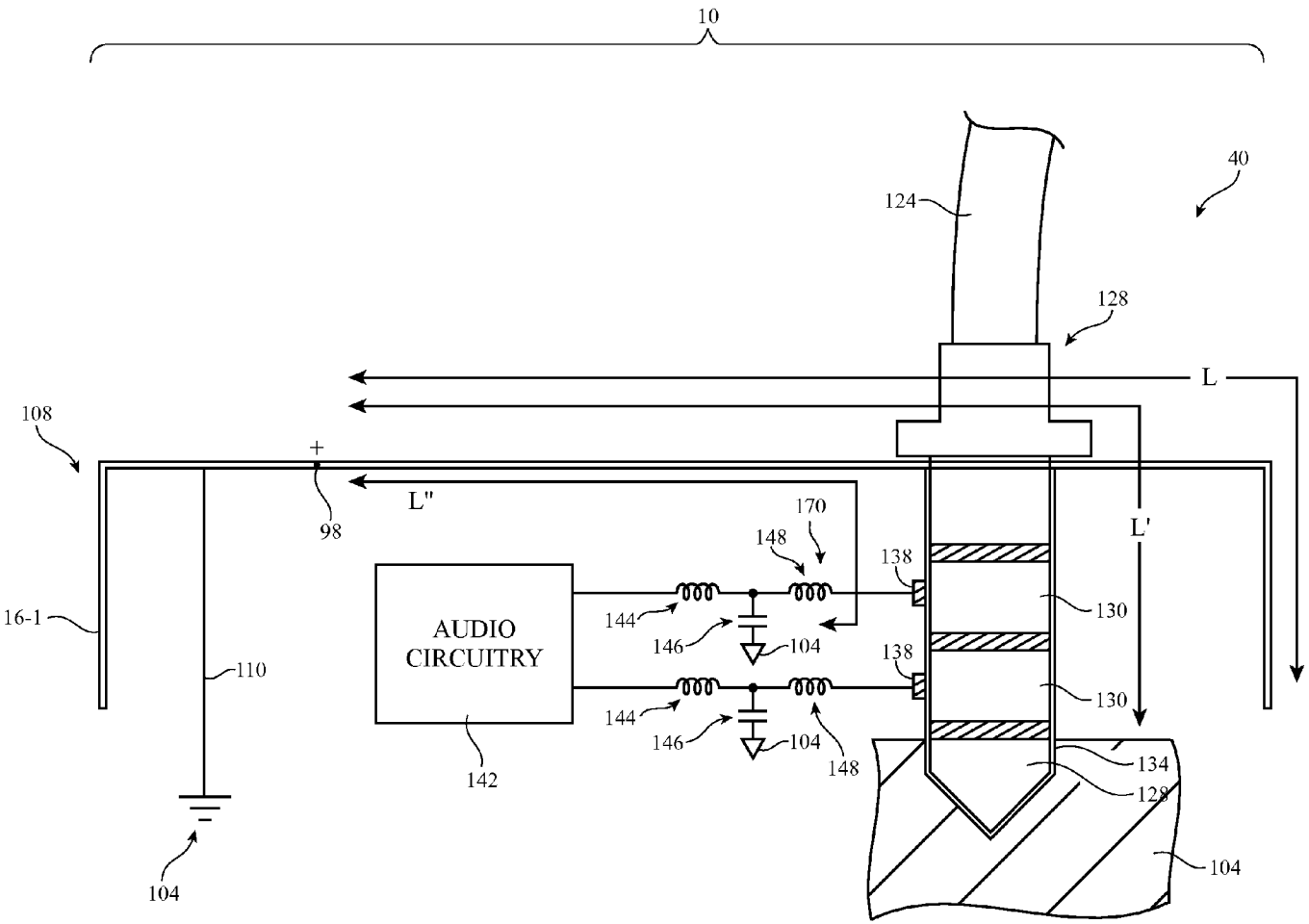
FIG. 11 is a diagram of a portion of an electronic device containing an antenna and interference mitigation circuitry of the type shown in FIG. 10 in accordance with an embodiment.

Interference mitigation circuitry 170 is preferably configured to ensure that antenna 40 will exhibit the same or similar performance both when audio plug 128 is absent from jack 134 and device 10 and when audio plug 128 is present within jack 134 and device 10. In the absence of plug 128, antenna currents flow within peripheral conductive structures 16-1. As shown in FIG. 11, there may be a distance L associated with the length of structures 16-1 between feed terminal 98 (the feed of antenna 40) and the end of structures 16-1 (e.g., the end of structures 16-1 that is on the right-hand side of device 10 in the example of FIG. 11). In the absence of audio plug 128, antenna currents may flow over distance L between the antenna feed of antenna 40 and the end of antenna resonating element 108. The length of this branch of antenna resonating element 108 (i.e., length L) affects the frequency response of antenna 40 (e.g., L may be about a quarter of a wavelength at a resonant frequency of interest for antenna 40).

When audio plug 128 is plugged into device 10, parasitic antenna currents are drawn into plug 128 and jack 134 from structures 16-1. In the absence of interference mitigation circuitry 170, these currents can flow over an effective distance L'. As shown in FIG. 11, a part of audio jack 134 (e.g., the tip of jack 134 or other portion of jack 134) may overlap antenna ground 104. As a result, there may be a coupling capacitance between audio jack 134 (and therefore plug 128) and ground 104. Because of the capacitance between ground 104 and plug 128 due to the overlap of jack 134 and ground 104, signals from plug 128 can flow to ground 104 from structures 16-1 (as illustrated by effective resonating element length L'). The presence of the capacitance in this path electrically increases the effective length of distance L'. The physical length of this current path and increase in the effective length of distance L' due to the presence of the overlap (coupling) capacitance between ground 104 and plug 128 tends to make length L' larger in magnitude than length L. As a result, the frequency response of antenna 40 may be undesirably degraded and shifted to a lower resonant frequency than desired in the absence of interference mitigation circuitry 170.

In the presence of interference mitigation circuitry 170, however, bypass capacitors 146 allow the coupled antenna current in plug 128 to pass to ground 104 directly (i.e., without passing thought the coupling capacitance between ground 104 and overlapping audio plug 128). The presence of inductors 148 helps reduce the size of the effective length (length L") of the antenna current path when plug 128 is in jack 134 and thereby ensures that the antenna resonance is as desired. The magnitude of capacitors 146 may be relatively large (e.g., 56 pF, other values over 20 pF or over 40 pF or values under 70 pF). This relatively large size allows radio-frequency signals to be shorted to ground 104 without having an overly significant impact on effective length L". The value of inductors 148 (i.e., the values selected to ensure that the effective length L" of the path for antenna currents that are passing through structures 16-1 and plug 128 to ground from the antenna feed is as desired) may be, for example, 20 nH or less, 10 nH or less, etc.

Inductors 148 may be fixed inductors (i.e., the sizes of inductors 148 may be selected as part of the design process for device 10) and/or may be variable inductors (e.g., inductors that have inductance values that can be adjusted in real time by control circuitry in device 10 to enhance antenna performance under a variety of operating conditions).

Figure 12:
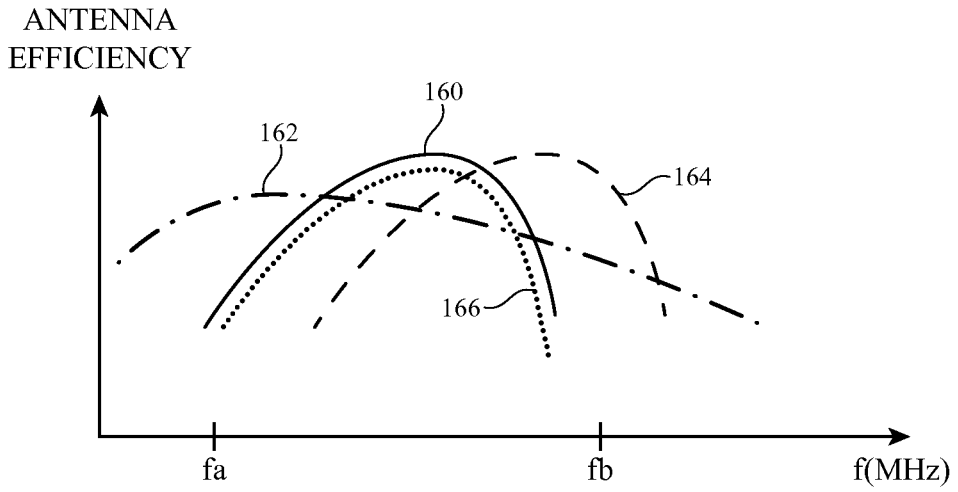
FIG. 12 is a graph in which antenna performance (antenna efficiency) has been plotted as a function of operating frequency for various operating conditions and antenna configurations for an illustrative antenna in accordance with an embodiment.

By appropriate selection of the size of the capacitance of each bypass capacitor 144 and the size of each series inductor 148, antenna 40 can perform satisfactorily under both plug in and plug out conditions. The performance of antenna 40 under a variety of different operating scenarios is shown in FIG. 12. In the graph of FIG. 12, antenna performance (i.e., antenna efficiency) has been plotted as a function of operating frequency f for frequencies between low frequency fa and high frequency fb. Frequencies fa and fb may be, for example, 700 MHz and 960 MHz or other frequencies associated with the operation of antenna 40.

In the absence of plug 128, antenna 40 may exhibit antenna resonance 160. In this example, the antenna frequency response associated with resonance 160 is the normal desired frequency response for antenna 40 and is the frequency response achieved in device 10 when plug 128 is not present.

In the absence of interference mitigation circuitry 170, the presence of audio plug 128 may create an antenna current path to ground 104 having an effective length L' that is greater than L due to the location and shape of plug 128 and due to the coupling capacitance associated with the overlap between plug 128 and ground 104. This increase in effective path length L' over nominal length L may result in antenna detuning. In particular, desired antenna resonance 160 may be shifted to a lower frequency than desired and may become less efficient, as shown by degraded antenna resonance peak 162 of FIG. 12.

To avoid undesired performance degradations of the type shown by curve 162, interference mitigation circuitry 170 may be incorporated into device 10. In the presence of bypass capacitor(s) 146, antenna signals will be grounded at ground 104 without passing through the coupling capacitance between plug 128 and overlapped ground 104. Because the value of capacitors 146 is relatively large, antenna signals will tend to be drawn to ground 104 through bypass capacitors 146 rather than being coupled into wires 126 in cable 124. Due to the presence of the bypass capacitor and the geometry of the bypass path to ground 104, however, resonance 160 may tend to shift to higher frequencies (in the absence of inductors 148), as illustrated by antenna resonance 164 of FIG. 12.

To ensure that antenna 40 performs as desired, inductors 148 may be coupled between capacitors 146 and plug 128 (i.e., between capacitors 146 and contacts 138), as shown in interference mitigation circuitry 170 of FIG. 10. Inductors 148 serve as resonant frequency tuning inductors and shift the resonant frequency of antenna 40 from that shown by resonant curve 164 of FIG. 12 to that of resonant curve 166 of FIG. 12. As shown in FIG. 12, antenna resonance 166, which may be achieved when plug 128 is present in an antenna 40, may be the same as or nearly the same as normal operation antenna resonance 160.

The foregoing is merely illustrative and various modifications can be made by those skilled in the art without departing from the scope and spirit of the described embodiments. The foregoing embodiments may be implemented individually or in any combination.

What is claimed is:

1. Apparatus, comprising:

an antenna formed from an antenna resonating element and an antenna ground;

an electrical connector that has contacts and that is configured to receive a mating connector, wherein the electrical connector is capacitively coupled to the antenna ground; and an interference mitigation circuit coupled between antenna ground and the electrical connector, wherein the interference mitigation circuit includes at least one capacitor and currents from the antenna resonating element flow through the electrical connector and the at least one capacitor to the antenna ground.

2. The apparatus defined in claim 1 wherein the capacitor has a first terminal that is coupled to the antenna ground and a second terminal coupled to a node in the interference mitigation circuit.

3. The apparatus defined in claim 2 wherein the interference mitigation circuit includes an inductor having a first terminal coupled to the node and a second terminal coupled to one of the contacts.

4. The apparatus defined in claim 3 further comprising:

circuitry; and a radio-frequency signal blocking inductor that is coupled between the circuitry and the node.

5. The apparatus defined in claim 4 wherein the circuitry comprises audio circuitry.

6. The apparatus defined in claim 5 wherein the connector is an audio jack.

7. The apparatus defined in claim 6 wherein the antenna resonating element comprises peripheral conductive electronic device housing structures.

8. The apparatus defined in claim 7 wherein the peripheral conductive electronic device housing structures have an opening aligned with the audio jack.

9. The apparatus defined in claim 8 wherein the antenna resonating element comprises an inverted-F antenna resonating element.

10. The apparatus defined in claim 9 further comprising an adjustable inductor coupled between the antenna resonating element and the antenna ground.

11. The apparatus defined in claim 1 wherein the contacts in the connector comprise a first contact and a second contact, the interference mitigation circuit includes at least first and second inductors, and the first inductor is connected to the first contact and the second inductor is connected to the second contact.

12. The apparatus defined in claim 11 wherein the capacitor is one of a set of first and second capacitors, the first capacitor has a terminal that is connected to the first inductor at a first node, and the second capacitor has a terminal that is connected to the second inductor at a second node.

13. The apparatus defined in claim 12 further comprising:

an audio circuit having first and second ports;

a third inductor coupled between the first port and the first node; and a fourth inductor coupled between the second port and the second node.

14. The apparatus defined in claim 13 wherein the connector comprises an audio jack having at least three contacts.

15. An electronic device, comprising:

a conductive housing structure;

an antenna formed from an antenna resonating element that includes at least part of the conductive housing structure and from an antenna ground;

an audio connector mounted in an opening in the conductive housing structure, wherein the audio connector has a contact and the audio connector is capacitively coupled to the antenna resonating element;

an audio circuit having a port;

first and second inductors that are connected at a node and that are coupled in series between the port and the contact; and a capacitor coupled to the node, wherein antenna currents from the antenna resonating element flow through the audio connector and the capacitor to the antenna ground.

16. The electronic device defined in claim 15 wherein the capacitor has a first terminal connected to the node and a second terminal connected to the antenna ground.

17. The electronic device defined in claim 16 wherein the antenna resonating element is an inverted-F antenna resonating element that is separated from the antenna ground by a gap and the electronic device further comprises an adjustable inductor that is coupled across the gap between the inverted-F antenna resonating element and the antenna ground.

18. The electronic device defined in claim 15 wherein the first and second inductors are tunable inductors.

19. An electronic device, comprising:

peripheral conductive housing structures having an opening;

an audio jack aligned with the opening, wherein the audio jack has first and second contacts;

a hybrid inverted-F slot antenna, wherein the hybrid inverted-F slot antenna has an inverted-F antenna portion formed from an inverted-F antenna resonating element and an antenna ground, the inverted-F antenna resonating element is formed from the peripheral conductive housing structures, the hybrid inverted-F slot antenna has a slot antenna portion formed from an opening between the inverted-F antenna resonating element and the antenna ground, and the hybrid inverted-F antenna has an antenna feed that feeds both the inverted-F antenna portion and the slot antenna portion;

a first capacitor having a first terminal directly coupled to the antenna ground and having a second terminal;

a first inductor having a first terminal directly coupled to the first contact and having a second terminal directly coupled to the second terminal of the first capacitor;

a second capacitor having a first terminal directly coupled to the antenna ground and having a second terminal; and a second inductor having a first terminal directly coupled to the second contact and having a second terminal directly coupled to the second terminal of the second capacitor.

20. The electronic device defined in claim 19 further comprising:

audio circuitry having first and second ports;

a third inductor coupled between the first port and the second terminal of the first capacitor; and a fourth inductor coupled between the second port and the second terminal of the second capacitor.

21. The electronic device defined in claim 20 wherein the audio jack has a portion that overlaps the antenna ground.

* * * * *